US010600376B2

(12) United States Patent
Yang et al.

(10) Patent No.: US 10,600,376 B2
(45) Date of Patent: Mar. 24, 2020

(54) METHOD AND SYSTEM FOR INCREASING COLOUR GAMUT OF DISPLAY DEVICE

(71) Applicant: Wuhan China Star Optoelectronics Technology Co., Ltd., Wuhan, Hubei (CN)

(72) Inventors: Yong Yang, Hubei (CN); Yingbao Yang, Hubei (CN)

(73) Assignee: WUHAN CHINA STAR OPTOELECTRONICS TECHNOLOGY CO., LTD., Wuhan (CN)

( * ) Notice: Subject to any disclaimer, the term of this patent is extended or adjusted under 35 U.S.C. 154(b) by 262 days.

(21) Appl. No.: 15/579,151

(22) PCT Filed: Nov. 21, 2017

(86) PCT No.: PCT/CN2017/112125

§ 371 (c)(1),
(2) Date: Dec. 1, 2017

(87) PCT Pub. No.: WO2019/085053

PCT Pub. Date: May 9, 2019

(65) Prior Publication Data

US 2019/0385543 A1 Dec. 19, 2019

(30) Foreign Application Priority Data

Oct. 31, 2017 (CN) ..... 2017 1 1049617

(51) Int. Cl.
*G09G 3/36* (2006.01)

(52) U.S. Cl.
CPC ... *G09G 3/3607* (2013.01); *G09G 2320/0666* (2013.01); *G09G 2340/06* (2013.01)

(58) Field of Classification Search
None
See application file for complete search history.

(56) References Cited

U.S. PATENT DOCUMENTS 4,721,951 A * 1/1988 Holler ..... H04N 1/622 345/603
8,743,152 B2 * 6/2014 Sakaigawa ..... G09G 3/3406 345/690

(Continued)

FOREIGN PATENT DOCUMENTS

CN 102262868 A 11/2011
CN 102521610 A 6/2012

(Continued)

*Primary Examiner* — Kee M Tung
*Assistant Examiner* — Patrick F Valdez
(74) *Attorney, Agent, or Firm* — Hemisphere Law, PLLC; Zhigang Ma

(57) ABSTRACT

A method and system for increasing colour gamut of display device are provided, the method comprising following steps. Obtaining RBG value of image. Transferring RGB value from RGB space to HSV space for obtaining saturation of each solid color images of image. Determining whether if percentage of an area which saturation of each natural color is greater than first threshold value in solid color image is occupied on an area of whole image is greater than second threshold value. Adjusting RGB value of solid color image for obtaining adjusted RGB value of adjusted solid color image, if percentage of an area which saturation of natural color is greater than first threshold value in solid color image is occupied on an area of whole image is greater than second threshold value. Outputting adjusted RGB value of the adjusted solid color image.

7 Claims, 2 Drawing Sheets

(56) References Cited

U.S. PATENT DOCUMENTS

| | | | | |
|---|---|---|---|---|
| 2003/0160900 | A1* | 8/2003 | Dumitras | H04N 9/67 348/649 |
| 2006/0140510 | A1* | 6/2006 | Wallace | G06K 9/00362 382/294 |
| 2009/0290807 | A1* | 11/2009 | Marchesotti | H04N 5/57 382/261 |
| 2010/0079479 | A1* | 4/2010 | Kurokawa | G09G 3/3655 345/590 |
| 2013/0027445 | A1 | 1/2013 | Tsai et al. | |
| 2015/0138227 | A1* | 5/2015 | Zhao | H04N 5/57 345/601 |
| 2017/0018231 | A1 | 1/2017 | Liu | |
| 2017/0352304 | A1* | 12/2017 | Funatsu | H01L 27/3211 |
| 2018/0018793 | A1* | 1/2018 | Min | G06T 5/009 |

FOREIGN PATENT DOCUMENTS

| | | | | |
|---|---|---|---|---|
| CN | 105069756 | | 11/2015 | |
| CN | 106098014 | A | 11/2016 | |
| CN | 106648493 | A | 5/2017 | |
| CN | 106652939 | | 5/2017 | |
| CN | 106782370 | A | 5/2017 | |
| CN | 107146569 | A | 9/2017 | |
| EP | 3429180 | A1 * | 1/2019 | H04N 1/6005 |
| WO | WO 2016206183 | | 12/2016 | |

* cited by examiner

METHOD AND SYSTEM FOR INCREASING COLOUR GAMUT OF DISPLAY DEVICE

RELATED APPLICATIONS

The present application is a National Phase of International Application Number PCT/CN2017/112125, filed Nov. 21, 2017, and claims the priority of China Application No. 201711049617.2, filed Oct. 31, 2017.

FIELD OF THE DISCLOSURE

The disclosure relates to a liquid crystal display technical field, and more particularly to a method and system for increasing colour gamut of display device.

BACKGROUND

With the development of liquid crystal display technology, an important direction is to enhance colour gamut of liquid crystal display device. Current, the colour gamut of the liquid crystal display device is enhancing to 95% NTSC from the beginning of 70% NTSC, and then enhances to 120% NTSC. When the colour gamut of the liquid crystal display device from 70% NTSC enhancing to 95% NTSC, most of problem from the backlight to color photoresist already be overcome. However, when the colour gamut of the liquid crystal display device is enhancing to 120% NTSC, a lot of audiences give response for reduce the eye-comfort of solid color image. The probably reason is because the pure color of high color gamut is beyond the nature color range, and human's eyes never see this color before and feel strange. Therefore, it decreases the high color gamut acceptance on marketing. Until now, there still does not have any better solution.

SUMMARY

A technical problem to be solved by the disclosure is to provide a method and system for increasing colour gamut of display device, which is enhances the eye-comfort for solid color image of high color gamut, and increases the high color gamut acceptance on marketing.

An objective of the disclosure is achieved by following embodiments. In particular, a method for increasing colour gamut of display device, comprising following steps:

Obtaining a RBG value of an image.

Transferring the RGB value from RGB space to HSV space for obtaining saturation of each solid color images of the image.

Determining whether if percentage of an area which saturation of each natural colors is greater than a first threshold value in the solid color image are occupied on an area of whole image is greater than a second threshold value.

Adjusting the RGB value of the solid color image for obtaining an adjusted RGB value of the adjusted solid color image, when percentage of the area which saturation of the natural color is greater than the first threshold value in the solid color image are occupied on an area of whole image is greater than the second threshold value.

Outputting the adjusted RGB value of the adjusted solid color image.

In an embodiment, specifically of adjusting the RGB value of the solid color image for obtaining the adjusted RGB value of the adjusted solid color image, includes decreasing gray value of the natural color of the solid color image, increasing gray value of other colors of the solid color image, and then obtaining the adjusted RGB value of the adjusted solid color image.

In an embodiment, the RGB value of solid color image is adjusted in accordance with the following formula:

$$G_1'=k_1\times\exp(1\times s)\times G_1+G_2'+G_3$$

$$G_2'=k_2\times\exp(-s)\times G_1$$

$$G_3'=k_3\times\exp(-s)\times G_1$$

wherein $k_1$, $k_2$ and $k_3$ are adjustment coefficients of the natural color and other two colors respectively, s is saturation of the solid color image, $G_1$ is gray value of the natural color of the solid color image, $G_1'$ is adjusted gray value of the natural color of the adjusted solid color image, $G_2'$, $G_3'$ are adjusted gray value of other two colors of the solid color image.

In an embodiment, outputting the RGB value of the solid color image, if percentage of the area which saturation of the natural color is not greater than the first threshold value in the solid color image are occupied on an area of whole image is greater than the second threshold value.

In an embodiment, the first threshold value is 80%.

In an embodiment, the second threshold value is not more than 50%.

In an embodiment, before the step of, obtaining the RBG value of the image further comprises steps:

Obtaining a RBG value of an original image.

Transferring the RBG value of the original image according to color gamut rang, obtaining the image.

In an embodiment, brightness of the adjusted solid color image is equal to brightness of the solid color image.

In an embodiment, transferring the RGB value from RGB space to HSV space in accordance with the following formula:

$$h=\begin{cases} 60^0\times\dfrac{G-B}{R-\min(R,G,B)}+0^0, & \text{if } \max(R,G,B)=R,\ G\geq B \\ 60^0\times\dfrac{G-B}{R-\min(R,G,B)}+360^0, & \text{if } \max(R,G,B)=R,\ G<B \\ 60^0\times\dfrac{B-R}{G-\min(R,G,B)}+120^0, & \text{if } \max(R,G,B)=G \\ 60^0\times\dfrac{R-G}{B-\min(R,G,B)}+240^0, & \text{if } \max(R,G,B)=B \end{cases},$$

$$s=\begin{cases} 0, \text{ if } \max(R,G,B)=0 \\ \dfrac{\max(R,G,B)-\min(R,G,B)}{\max(R,G,B)}=1-\dfrac{\min(R,G,B)}{\max(R,G,B)}, \text{ otherwise} \end{cases}$$

$$v=\max(R,G,B)$$

wherein, h is color tone of image, s is saturation of image, v is brightness of image.

According to another aspect of the disclosure, the disclosure further provides a system for increasing colour gamut of display device. The system for increasing colour gamut of display device includes an obtaining device, a transferring device, a determining device, an adjusting device and an outputting device.

The obtaining device for obtaining a RBG value of an image.

The transferring device for transferring the RGB value from RGB space to HSV space for obtaining saturation of each solid color images of the image.

The determining device for determining whether percentage of an area which saturation of each natural colors is greater than a first threshold value in the solid color image are occupied on an area of whole image is greater than a second threshold value.

The adjusting device for adjusting the RGB value of the solid color image for obtaining a adjusted RGB value of a adjusted solid color image, if percentage of an area which saturation of the natural color is greater than the first threshold value in the solid color image is occupied on an area of whole image is greater than the second threshold value.

The outputting device for outputting the adjusted RGB value of the adjusted solid color image.

The method and system for increasing colour gamut of display device, which is adjustment the RGB value of solid color image for enhances eye-comfort of solid color image of high colour gamut, and increases the high color gamut acceptance on marketing, when percentage of the area which saturation of the natural color is greater than the first threshold value in the solid color image are occupied on an area of whole image is greater than the second threshold value.

BRIEF DESCRIPTION OF THE DRAWINGS

Accompanying drawings are for providing further understanding of embodiments of the disclosure. The drawings form a part of the disclosure and are for illustrating the principle of the embodiments of the disclosure along with the literal description. Apparently, the drawings in the description below are merely some embodiments of the disclosure, a person skilled in the art can obtain other drawings according to these drawings without creative efforts. In the figures.

DETAILED DESCRIPTION OF PREFERRED EMBODIMENTS

The specific structural and functional details disclosed herein are only representative and are intended for describing exemplary embodiments of the disclosure. However, the disclosure can be embodied in many forms of substitution, and should not be interpreted as merely limited to the embodiments described herein.

The disclosure will be further described in detail with reference to accompanying drawings and preferred embodiments as follows.

Figure 1:
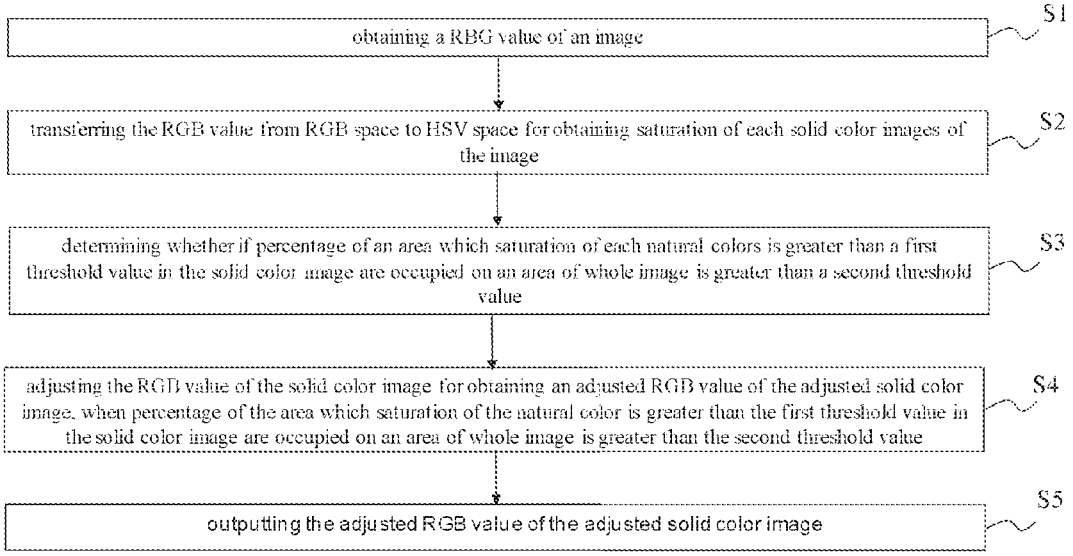
FIG. 1 is a flow chart of a method for increasing colour gamut of display device according to an embodiment of the disclosure.
Figure 2:
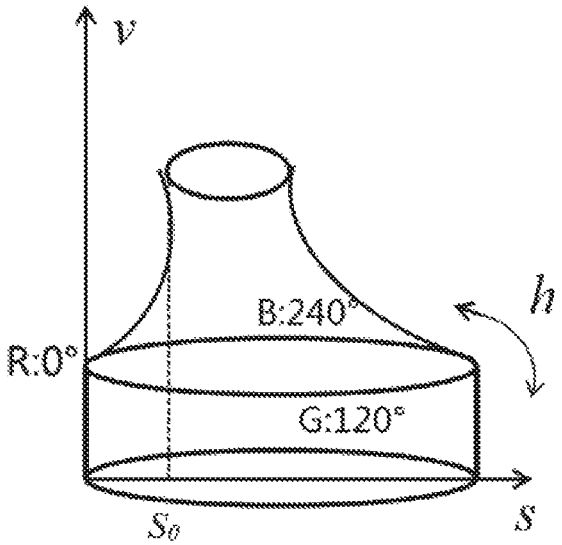
FIG. 2 is a schematic view of HSV space of an adjusted image according to an embodiment of the disclosure.

Please refer to FIG. 1, the display of this embodiment is RGB display device. Which is a pixel of the display device only includes R sub-pixel, G sub-pixel and B sub-pixel. The display device of this embodiment also could be other display device, here used the RGB display device only for convenience described, it is not limited thereto. In the following, a method and system for increasing colour gamut of display device of this embodiment is used RGB display device with the disclosure will be described below, which comprising following steps:

S1, obtaining the RBG value of an image, RGB value of image is gray value of image which includes R gray value, G gray value and B gray value;

S2, transferring the RGB value of the step 1 from RGB space to HSV space for obtaining saturation of each solid color images of the image. Which obtaining saturation of red color image, saturation of green color image and saturation of blue color image. HSV space is colour gamut space, H is color tone which is wave of light-emitting color, S is saturation of color which is purity of light-emitting color, V is brightness of color which is dark or bright of light-emitting color for eyes tristimulus. Please refer to FIG. 2.

S3, determining whether percentage of an area which saturation of each natural colors in step S2 is greater than a first threshold value $s_0$ in the solid color image are occupied on an area of whole image is greater than the second threshold value. Which it is, whether percentage of the area of which saturation of the red color is greater than the first threshold $s_0$ in the red color image are occupied on the area whole image is greater than the second threshold value; whether percentage of the area of which saturation of the green color image is greater than the first threshold $s_0$ in the green color are occupied on the area whole image is greater than the second threshold value; and whether percentage of the area of which saturation of the blue color is greater than the first threshold $s_0$ in the blue color image are occupied on the area whole image is greater than the second threshold value.

S4, if percentage of an area which saturation of the natural color is greater than a first threshold value $s_0$ in the solid color image are occupied on an area of whole image is greater than the second threshold value, then adjusting the RGB value of the solid color image for obtaining a adjusted RGB value of the adjusted solid color image. Which it is, if percentage of an area which saturation of the red color is greater than a first threshold value $s_0$ in the red color image are occupied on an area of whole image is greater than the second threshold value, then adjusting the RGB value of the red color image for obtaining a adjusted RGB value of the adjusted red color image, if percentage of an area which saturation of the green color is greater than a first threshold value $s_0$ in the green color image are occupied on an area of whole image is greater than the second threshold value, then adjusting the RGB value of the green color image for obtaining a adjusted RGB value of the adjusted green color image if percentage of an area which saturation of the blue color is greater than a first threshold value $s_0$ in the blue color image are occupied on an area of whole image is greater than the second threshold value, then adjusting the RGB value of the blue color image for obtaining a adjusted RGB value of the adjusted blue color image.

S5, outputting an adjusted RGB value of the adjusted solid color image. Which it is, outputting the adjusted RGB value of the adjusted red color image, the adjusted RGB value of the adjusted green color image, the adjusted RGB value of the adjusted blue color image.

Specifically, in the step S4, adjusting the RGB value of the solid color image for obtaining the adjusted RGB value of the adjusted solid color image, which is according to decreasing gray value of the natural color of the solid color image, increasing gray value of other colors of the solid color image. That is, obtaining the adjusted RGB value of the adjusted solid color image by increasing other colors for decreasing saturation of the solid color image. Please refer to top half portion of the twist HSV color space of FIG. 2. Therefore, it could avoid highly saturation of solid color image and reducing eye comfort.

The RGB value of solid color image is adjusted in accordance with the following formula:

$$G_1'=k_1\times\exp(1\times s)\times G_1+G_2'+G_3'$$

$$G_2'=k_2\times\exp(-s)\times G_1$$

$$G_3'=k_3\times\exp(-s)\times G_1$$

Wherein $k_1$, $k_2$ and $k_3$ are adjustment coefficients of the natural color and other two colors respectively, s is saturation of the solid color image. $G_1$ is gray value of the natural color of the solid color image. $G_1'$ is adjusted gray value of the natural color of the adjusted solid color image, $G_2'$,$G_3'$ are adjusted gray value of other two colors of the solid color image.

The RGB value of the different solid color image will be adjusted as following described. For the red color image, RGB value of red color image is adjusted in accordance with the following formula:

$$G_R'=k_1\times\exp(1-s)\times G_R+G_G'+G_B'$$

$$G_G'=k_2\times\exp(-s)\times G_R$$

$$G_B'=k_3\times\exp(-s)\times G_R$$

Wherein $k_1$, $k_2$ and $k_3$ are adjustment coefficients of the RGB, s is saturation of the red color image, $G_R$ is red gray value, $G_R'$ is red gray value of the red color image after adjustment. $G_G'$, $G_B'$ are green gray value and blue gray value of the red color image after adjustment.

For the green color image. RGB value of green color image is adjusted in accordance with the following formula:

$$G_G'=k_1'\times\exp(1-s')\times G_G+G_R'+G_B'$$

$$G_R'=k_2'\times\exp(-s')\times G_G$$

$$G_B'=k_3'\times\exp(-s')\times G_R$$

Wherein $k_1'$, $k_2'$, $k_3'$ are adjustment coefficients of the RGB, s' is saturation of the green color image, $G_G$ is green gray value, $G_G'$ is green gray value of the green color image after adjustment, $G_R'$, $G_B'$ are red gray value and blue gray value of the green color image after adjustment.

For the blue color image, RGB value of blue color image is adjusted in accordance with the following formula:

$$G_B'=k_1''\times\exp(1-s'')\times G_B+G_R'+G_G'$$

$$G_R'=k_2''\times\exp(-s'')\times G_B$$

$$G_G'=k_3''\times\exp(-s'')\times G_B$$

Wherein $k_1''$, $k_2''$, $k_3''$ are adjustment coefficients of the RGB, s" is saturation of the blue color image, $G_B$ is blue gray value. $G_B'$ is blue gray value of the blue color image after adjustment, $G_R'$, $G_G'$ are red gray value and green gray value of the blue color image after adjustment.

Wherein, $k_1$, $k_2$, $k_3$ could be adjustment according the requirement, and also the $k_1'$, $k_2'$, $k_3'$ and $k_1''$,$k_2''$, $k_3''$ could be adjustment according the requirement.

In the step S4, if percentage of an area which saturation of the natural color is greater than the first threshold value $s_0$ in the solid color image are occupied on an area of whole image is not greater than the second threshold value, then outputting the RGB value of the solid color image. Please refer to bottom half portion of the twist HSV color space of FIG. 2.

Preferably, the first threshold value of this embodiment is 80%, the second threshold is not more than 50%. The specifically value could be choose by parameter of display device.

In this embodiment, before the step S1, the method for increasing colour gamut of display device further comprises steps:

S01, obtaining a RBG value of an original image.

S02, transferring the RBG value of the original image according to color gamut rang, and obtaining the image of S1. Matching the obtaining image after transfer and the colour gamut of display device for display the original image better.

Preferably, in order to not affect the display effect, brightness of the adjusted solid color image is equal to brightness of the solid color image. That is, adjustment of RGB value of solid color image will not changing the brightness of solid color image.

In the step of this embodiment, transferring the RGB value from RGB space to HSV space in accordance with the following formula:

$$h=\begin{cases}60^0\times\dfrac{G-B}{R-\min(R,G,B)}+0^0, & \text{if } \max(R,G,B)=R,\ G\geq B\\ 60^0\times\dfrac{G-B}{R-\min(R,G,B)}+360^0, & \text{if } \max(R,G,B)=R,\ G<B\\ 60^0\times\dfrac{B-R}{G-\min(R,G,B)}+120^0, & \text{if } \max(R,G,B)=G\\ 60^0\times\dfrac{R-G}{B-\min(R,G,B)}+240^0, & \text{if } \max(R,G,B)=B\end{cases}$$

$$s=\begin{cases}0, \text{ if } \max(R,G,B)=0\\ \dfrac{\max(R,G,B)-\min(R,G,B)}{\max(R,G,B)}=1-\dfrac{\min(R,G,B)}{\max(R,G,B)}, \text{ otherwise}\end{cases}$$

$$v=\max(R,G,B)$$

Wherein, h is color tone of image, s is saturation of image, v is brightness of image.

Figure 3:
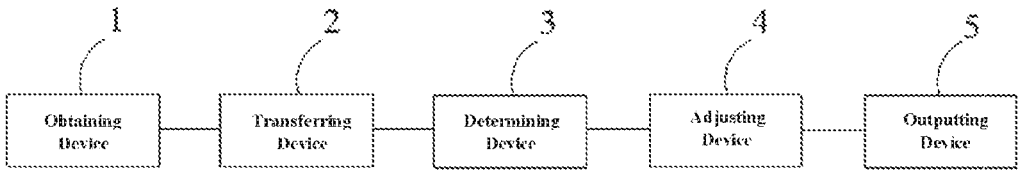
FIG. 3 is a structural schematic view of a system for increasing colour gamut of display device according to an embodiment of the disclosure.

Please refer to FIG. 3, the system for increasing colour gamut of display device of this embodiment comprises an obtaining device 1, a transferring device 2, a determining device 3, an adjusting device and an outputting device 5.

The obtaining device 1 for obtaining the RBG value of an image. The transferring device 2 for transferring the RGB value from a RGB space to HSV space, and obtaining saturation of each solid color images of the image. The determining device 3 for determining whether percentage of an area which saturation of each natural colors is greater than a first threshold value $s_0$ in the solid color image are occupied on an area of whole image is greater than the second threshold value. The adjusting device 4 for adjusting the RGB value of the solid color image for obtaining a adjusted RGB value of the adjusted solid color image, if percentage of an area which saturation of the natural color is greater than a first threshold value $s_0$ in the solid color image are occupied on an area of whole image is greater than the second threshold value. The outputting device 5 for outputting the adjusted RGB value of the adjusted solid color image to display device.

The adjusting device 4 further using for that, if percentage of an area which is saturation of the natural color greater than a first threshold value $s_0$ in the solid color image is occupied on an area of whole image is not greater than the second threshold value, the adjusting device 4 will not adjust the RGB value of solid color image and use the RGB value of the solid color image to be the adjusted RGB value of the adjusted solid color image.

The obtaining device 1 further for obtaining a RBG value of an original image. The transferring device 2 further for transferring the RBG value of the original image according to color gamut rang, and obtaining the image.

The foregoing contents are detailed description of the disclosure in conjunction with specific preferred embodiments and concrete embodiments of the disclosure are not limited to these description. For the person skilled in the art of the disclosure, without departing from the concept of the disclosure, simple deductions or substitutions can be made and should be included in the protection scope of the application.

What is claimed is:

1. A method for increasing colour gamut of display device, comprising steps:

obtaining an RBG value of an image;

transferring the RGB value from RGB space to HSV space for obtaining saturation of each solid color image of the image;

determining a percentage of an area in which the saturation of each natural color is greater than a first threshold value, determining if the percentage is greater than a second threshold value;

adjusting the RGB value of the solid color image for obtaining an adjusted RGB value of the adjusted solid color image, when percentage of the area which saturation of the natural color is greater than the first threshold value in the solid color image are occupied on an area of whole image is greater than the second threshold value; and outputting the adjusted RGB value of the adjusted solid color image;

wherein adjusting the RGB value of the solid color image includes decreasing a gray value of the natural color of the solid color image, and increasing the gray values of the colors of the other solid color images, and then obtaining the adjusted RGB value of the adjusted solid color images;

wherein the RGB value of solid color image is adjusted in accordance with the following formula:

$$G_1'=k_1\times\exp(1-s)\times G_1+G_2'+G_3'$$

$$G_2'=k_2\times\exp(-s)\times G_1$$

$$G_3'=k_3\times\exp(-s)\times G_1$$

wherein $k_1$, $k_2$ and $k_3$ are adjustment coefficients of the natural color and other two colors respectively, S is saturation of the solid color image, $G_1$ is gray value of the natural color of the solid color image, $G_1'$ is adjusted gray value of the natural color of the adjusted solid color image, $G_2'$, $G_3'$ are adjusted gray value of other two colors of the solid color image.

2. The method for increasing colour gamut of display device according to claim 1, wherein outputting the RGB value of the solid color image in which the saturation of the natural color is not greater than the first threshold value in the solid color image, if the percentage of area is greater than the second threshold value.

3. The method for increasing colour gamut of display device according to claim 1, wherein the first threshold value is 80%.

4. The method for increasing colour gamut of display device according to claim 1, wherein the second threshold value is not more than 50%.

5. The method for increasing colour gamut of display device according to claim 1, wherein before the step of obtaining the RBG value of the image, further comprises steps:

obtaining an RBG value of an original image;

transferring the RBG value of the original image according to color gamut range, obtaining the image.

6. The method for increasing colour gamut of display device according to claim 1, wherein brightness of the adjusted solid color image is equal to brightness of the solid color image.

7. The method for increasing colour gamut of display device according to claim 1, wherein transferring the RGB value from RGB space to HSV space in accordance with the following formula:

$$h=\begin{cases} 60^0\times\dfrac{G-B}{R-\min(R,G,B)}+0^0, & \text{if } \max(R,G,B)=R,\ G\geq B \\ 60^0\times\dfrac{G-B}{R-\min(R,G,B)}+360^0, & \text{if } \max(R,G,B)=R,\ G<B \\ 60^0\times\dfrac{B-R}{G-\min(R,G,B)}+120^0, & \text{if } \max(R,G,B)=G \\ 60^0\times\dfrac{R-G}{B-\min(R,G,B)}+240^0, & \text{if } \max(R,G,B)=B \end{cases},$$

$$s=\begin{cases} 0, \text{ if } \max(R,G,B)=0 \\ \dfrac{\max(R,G,B)-\min(R,G,B)}{\max(R,G,B)}=1-\dfrac{\min(R,G,B)}{\max(R,G,B)}, \text{ otherwise} \end{cases}$$

$$v=\max(R,G,B)$$

wherein, h is color tone of image, S is saturation of image, V is brightness of image.

* * * * *